United States Patent [19]

van Klinken

[11] Patent Number: 4,484,835

[45] Date of Patent: Nov. 27, 1984

[54] METHOD AND APPARATUS FOR INSTALLING GROUND-WATER BARRIER

[75] Inventor: Peter G. van Klinken, Oudenbosch, Netherlands

[73] Assignee: Stevin Construction Inc., Dover, Del.

[21] Appl. No.: 415,803

[22] Filed: Sep. 8, 1982

[30] Foreign Application Priority Data

Sep. 25, 1981 [NL] Netherlands ..... 8104253

[51] Int. Cl.[3] ..... E02D 19/12

[52] U.S. Cl. ..... 405/52; 405/36; 405/258; 405/270

[58] Field of Search ..... 405/52, 55, 57, 58, 405/36, 270, 267, 50, 38

[56] References Cited

U.S. PATENT DOCUMENTS

| | | | |
|---|---|---|---|
| 1,058,077 | 4/1913 | Luce | 405/109 |
| 3,380,252 | 4/1968 | Renshaw | 405/270 |
| 3,618,329 | 11/1971 | Hanson | 405/179 |
| 4,166,508 | 4/1979 | Berg | 405/50 X |
| 4,337,006 | 6/1982 | Lacey | 405/50 X |

FOREIGN PATENT DOCUMENTS

| | | | |
|---|---|---|---|
| 627142 | 5/1963 | Belgium . | |
| 1105805 | 4/1961 | Fed. Rep. of Germany . | |
| 2138123 | 7/1971 | Fed. Rep. of Germany . | |
| 2546946 | 4/1977 | Fed. Rep. of Germany . | |
| 2038719 | 1/1971 | France . | |
| 2316383 | 1/1977 | France . | |
| 643579 | 1/1979 | U.S.S.R. | 405/270 |

*Primary Examiner*—Dennis L. Taylor

[57] ABSTRACT

This invention relates to a method for introducing a ground water flow restricting or sealing screen into the soil comprising several side by side mounted whether or not overlapping flexible sheets which each are introduced into the soil with their lower edges by being releasably connected to a lance with substantially the same width and are sealed there to each other and anchored such that a continuous screen is formed, said lance being retracted after the placing of each individual sheet, the sealing of the edges being performed by overlapping and/or hardening material fed in at the location of said edge.

4 Claims, 19 Drawing Figures

METHOD AND APPARATUS FOR INSTALLING GROUND-WATER BARRIER

The invention relates to a method for manufacturing a ground water flow restricting or sealing screen in the soil by introducing water retaining elements from the land level downwardly into the soil such that said elements join each other with their edges.

Such a method is generally known for instance in the form of a pile planking, at which usually special profiled steel plankings with interengaging sections, which enable longitudinal displacement, are introduced into the soil by pile driving or vibrating. This known method is complicated and expensive and can give nuisance for the environment because of the pile driving or vibrating.

It is also known to produce slots which are filled by clay or bentonite-cement, which screens can encounter difficulties by being insufficient waterproof. Furthermore it is of course known to introduce concrete elements joining each other, in manufactured slots or to manufacture screens of concrete poured on the spot.

More and more inhabitants of extremely densed populated areas are confronted with ground pollution, for instance from leakages of storage tanks of fuels or chemicals or by penetration from dumping grounds.

It is the purpose of the invention to provide a method for manufacturing a ground water flow restricting or sealing screen which is simple and cheap and can be applied in several ways.

This is attained according to the invention by elements comprising wide less or more flexible sheets or foils, which are releasably attached with their lower edge to a lance with substantially the same width, which sheets are introduced into the soil by said lance, after which with simultaneously disconnecting of the sheets the lance is retracted and a sealing is brought about between the adjacent, each other overlapping edges of the respective successive sheets.

The more or less flexible sheets or foils which are applied according to this method can be formed from cloth which is impregnated with water retaining material, for instance a tar product, but preferably these elements comprise a sufficient rigid synthetic foil.

Lances formed like a tube are generally known. According to the invention a very wide lance is now used, for downwardly introducing the sheet which is attached thereto. The width of the sheet and the lance respectively is at least 1 m and preferably many meters. The lance is often introduced in the soil by vibration. After disconnecting the sheet the lance is retracted after which the sheet remains in the narrow slot. This slot is closed by sinking against the sheet, which sinking can be stimulated when the lance is subjected to vibration during the retracting.

The once mounted sheet is able to accommodate the ground water pressure because the sheet is supported against the walls of the slot which is obtained by injection and closed after retracting the lance.

It is of course desirable if not necessary that the edges of the sheets join each other sealingly. For this purpose many possibilities exist.

In its most simple form this can be realized by arranging the sheets or foils in overlapping position such that they seal upon each other by their overlapping edge faces with the edge face of each sheet over the edge face of the previous arranged sheet, which is turned towards the highest water pressure side. An overlap of some decimeters, for instance 2 dm, is intended. The sealing is brought about by the pressure of the ground and the ground water itself. One can also provide the sheets with means which allow a good sealing, for instance by providing the sheets at the each other overlapping longitudinal edge area with hollow inflatable edge strips, said edge strips are preferable strips which are fillable with a hardening material.

A more complicated solution can be obtained if downwardly directed bores are made in the soil according to the line of the path of the screen to be made, by drilling or injecting, which bores are spaced at a distance which is substantially equal or smaller than the width of the sheets and at which each sheet is downwardly introduced into the soil by the lance connected thereto with the edges at the location of two succeeding bores, after which, at least in the bore in which are the edges of two succeeding sheets, hardening material is introduced. If one proceeds according to this method the edges of the sheets will be in the area of the bores. These edges can overlap each other, they can end a short distance from each other and they even can be provided with inflatable edge strips. The sealing is brought about by introducing hardening material into the bores. This encloses the edges and ensures the sealing.

By using the inflatable edge strips one also obtains an anchoring in longitudinal direction of the screen as well as with or without application of the bores in the area of the longitudinal edges.

In order to ensure that the lower edge of the sheet remains down in the slot at the disconnecting of the sheet during the retraction of the lance, it can be preferable according to the invention to provide the sheet at the edge with a inflatable edge strip as well. Preferable a side edge strip is in continuing connection with this lower edge strip, so by filling a side edge strip of a recently mounted sheet, which overlaps a side edge of a preceding sheet, the lower edge is fixed simultaneously with the sealing and anchoring of these side edges.

With the application of inflatable edge strips it is further in many cases preferably to use edge strips of a material which is permeable for the hardening filling material. In this way is achieved that the hardening material penetrates into the surrounding ground and so improves the anchoring. Further an affixing to each other of the inflated side edges is achieved and with the application of vertical bores the filling of the bores is furthermore provided in this way or at simultaneously filling the bores and the side strips an intimate connection is produced.

The invention also relates to a lance for practising the method according to the invention at which lance the downwardly directed injection orifices of said lance comprise two parallel long rows divergently injecting spray nozzles.

To stimulate the discharging of soil and water the lance can further be provided with spray nozzles which are directed upwardly, i.e. contrary to the downwardly directed double row.

A lance with a single row of spray nozzles can of course also be used.

Preferably the lance is at both sides of the downwardly directed double row spray nozzles provided with toothstrips. These promote in cooperation with the jets of water cutting of the slot walls. During this they are continuously kept clean by the jets of water.

To prevent the lance deviating from the intended path said lance can be provided at the lower edge in the middle of the double row spray nozzles with a downwardly extending centering cone extending beyond said nozzles. Said cone just does not reach into the soil affected by the water jets.

For the releasable attachment of the sheet to the lance a lot of solutions are imaginable.

A very simple solution is achieved if the means for attaching the sheet comprise several pins spaced from each other against a side face and directed downwardly from this side face, which pins can cooperate with cloth eyelets in the sheet. These cloth eyelets are for instance situated above the inflatable strip and automatically slide from the pins as soon as the injection lance is retracted upwardly and the sheet is held by for instance the inflatable lower side strip or by other suitable means.

Another possibility consists in that the means for attaching of the sheet comprise one or more resilient clamps which while clearing the passage orifices for water, can engage U-like around the lower edge of the lance and to which the sheet is attached and which are provided with outwardly barblike extending resilient tongues, which are inclined upwardly as well as directly away from the legs of the U-shaped clamps if these are in the operating position of the lance. The sheet is fixed with the lower edge in the clamps which are themselves clamped to the lower edge of the injection lance. As soon as the lance is retracted, the resilient tongues acting like barbs remain sticking in the ground and hold the clamps and the sheet. The clamps are but lost in this way.

It is also imaginable that during the injection the lance is several times introduced and retracted before reaching the lowest position. The earlier described arrangements are not suitable for this method.

It will be perfectly clear that a lot of clamping constructions are imaginable which permanently hold the lower edge of the sheet even if this is provided with a inflatable strip, which clamp constructions can be placed into a position in which the lower edge of the sheet is released by actuating means which extend downwardly along the shaft of the lance. A simple arrangement may comprise a pivoting attachment of the downwardly directed pins, which cooperate with the cloth eyelets of the sheet, at a shaft and form them square or bended such that they can abut the side wall of the lance in a closed position or are moved away therefrom in a disconnecting position, so that the cloth eyelets can move downwardly with respect to the lance.

The invention will now be described more in detail referring to the drawings.

FIG. 1 is a front view of the apparatus for applying the method.

FIG. 2 corresponds to FIG. 1 and shows a position in which the method is almost completed.

FIG. 3 is a side view of the apparatus according to FIG. 1 and FIG. 2 in the initial position.

FIG. 4 relates to modification of the method shown in FIGS. 1–3.

Figure 1:
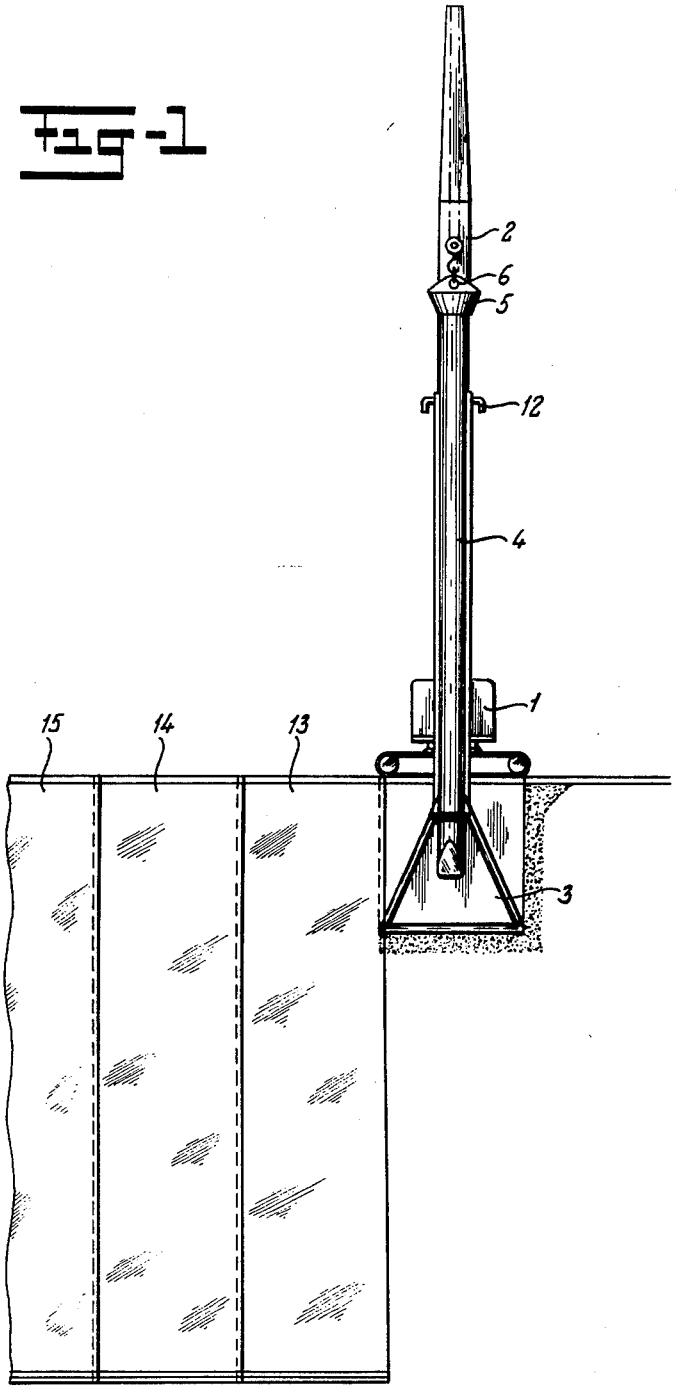

Referring to FIGS. 1–4 for the method according to the invention use is made of a movable crane 1 with crane jip 2, to which crane lance 3 is suspended by the intermediary of a rod 4 at the top end of which a vibration device 5 can be mounted as well as the eyelet 6 for the attachment to the hook of the crane. The sheet 8 coming from a storage reel 7 is guided over a reversing roller 9 and is at the lower side attached at 10 to the lance 3 itself.

The storage reel 7 with sheet 8 and the reversing roller 9 can be arranged on the only schematically shown separate apparatus 11, but can also be at the other side and being integrated with the frame of crane 1.

FIG. 1 shows the lance at which through line 12 water is supplied in a position in which said lance has already penetrated into the ground with some distance.

At the left hand side thereof a sheet 13 is present which has been introduced into the soil, which sheet at 14 joins in an overlapping way a previously places sheet 15.

Figure 2:
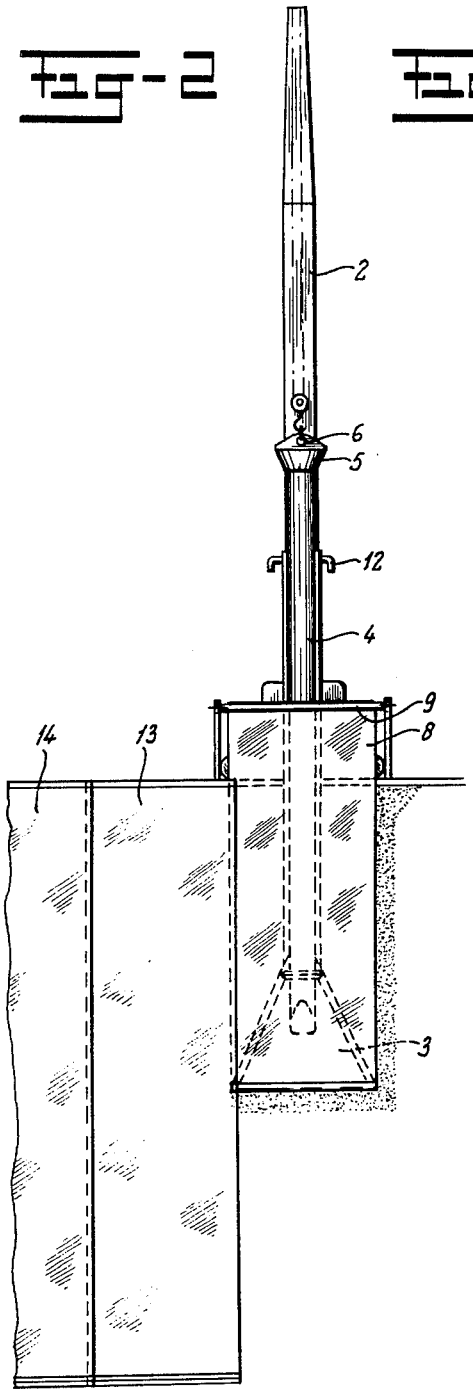

In FIG. 2 a lance is illustrated at a larger dephth with the sheet 8 connected thereto running over roller 9. This sheet 8 is omitted in FIG. 1 for sake of clearness.

Figure 3:
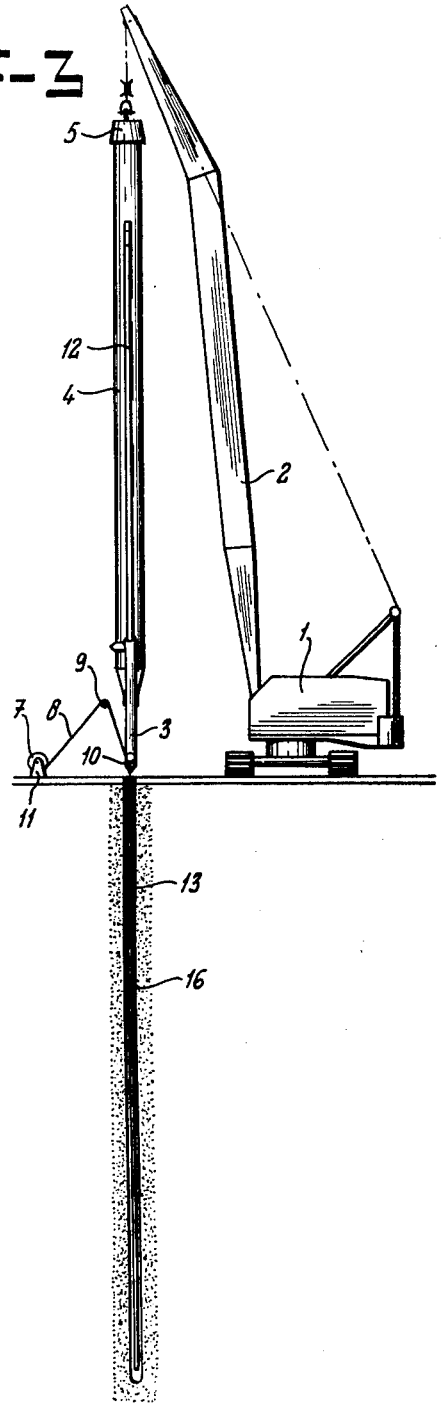
Figure 4:
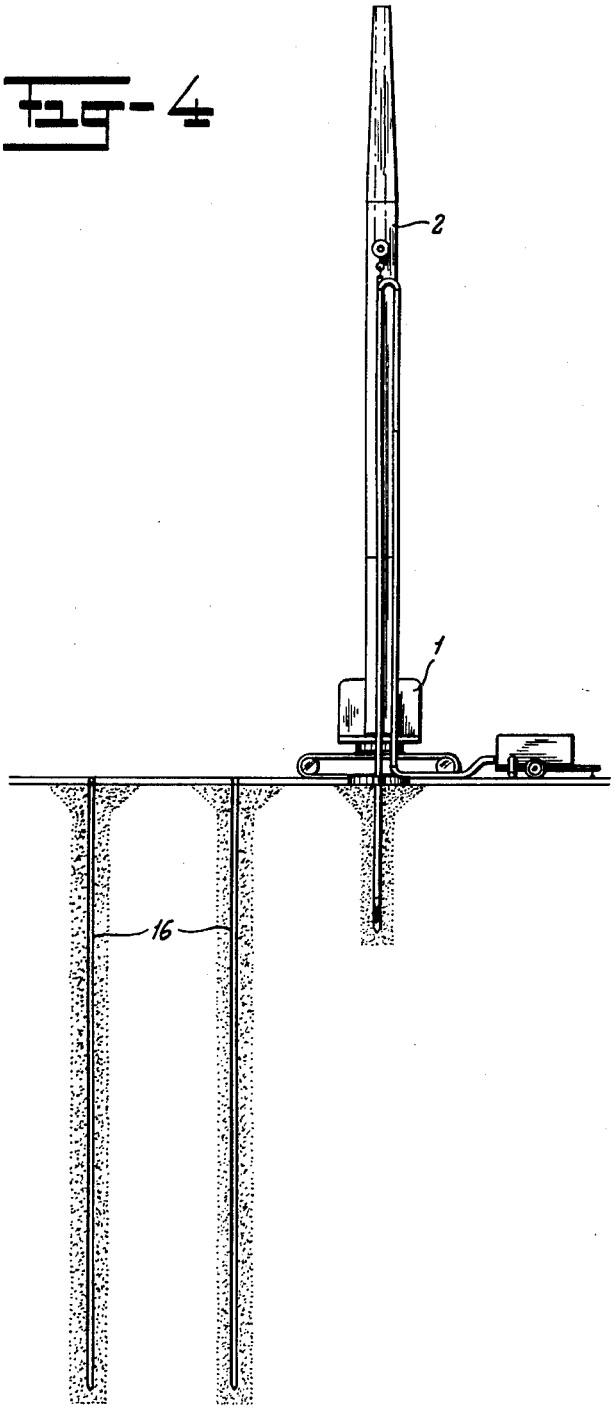

FIG. 3 shows the initial position of the apparatus at the introducing of a new sheet, at which the soil is shown in vertical section. This section represents the edge of the already introduced sheet 13 and a bore 16 provided in the area of the edge, said bore contrary to FIGS. 1 and 2 is previously provided by the method shown in FIG. 4. Said FIG. 4 shows that with the crane 1, 2 also an usual lance can be lowered by which vertical bores as bore 16 can be produced. These previously produced bores 16 can be of importance for the discharge of the water leaving the lance and the soil loosened by it and further can be of importance for the sealing of the edges of the sheets upon each other.

Figure 5:
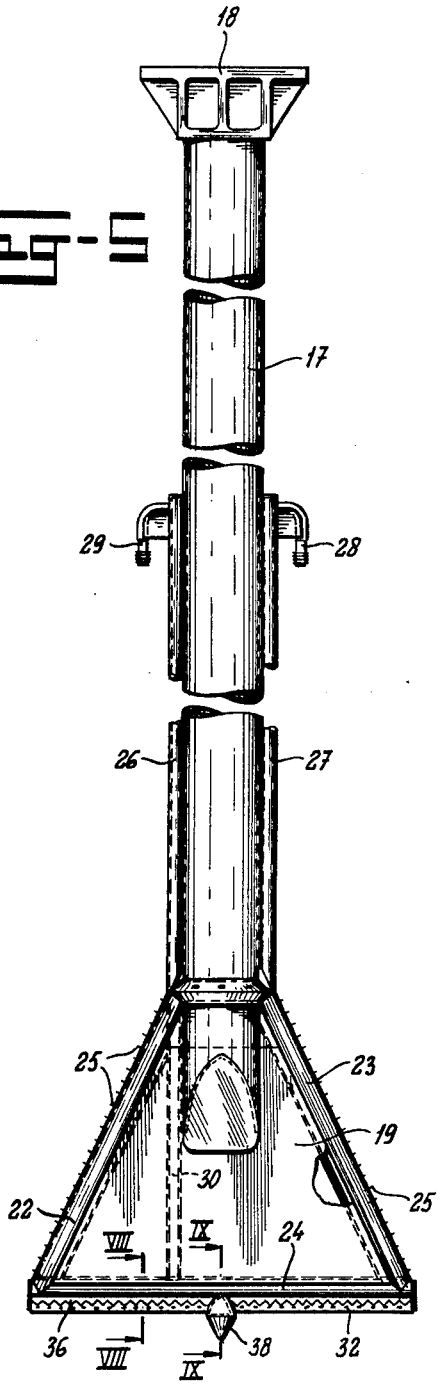
FIG. 5 is a front view of the lance for practising the method according to the invention.
Figure 7:
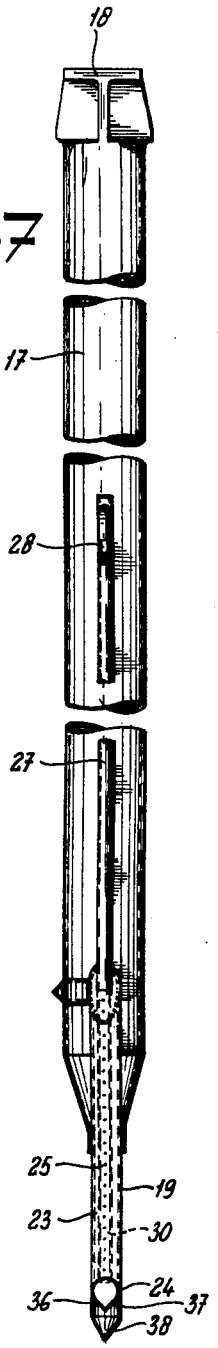
FIG. 7 is a side view of the lance according to FIG. 5.
Figure 6:
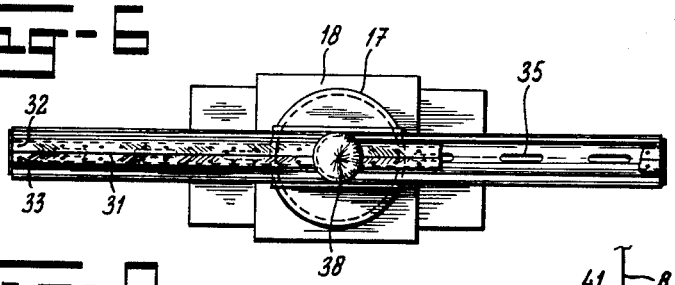
FIG. 6 is a bottom view of the lance according to FIG. 5.

In FIGS. 5, 6 and 7 the arrangement of the lance is shown, comprising a tube 17 with head 18. This tube is at the under end connected to a flat box 19, which is trapezoidal in side view and consist of two parallel walls 20 and 21 (FIGS. 8 and 9), which parallel walls 20 and 21 are welded to the tubes 22, 23 and 24 at the upright side edges and at the lower edge. The upright tubes 22 and 23 have a number of discharging openings schematically shown by the strips 25. These tubes join supply tubes 26 and 27 which are mounted along the big tube 17 and at which at 28, 29 respectively hoses or flexible lines can be connected. The tubes 22 and 23 are in open communication with the lower tube 24, which can also have a direct supply for instance through tube 30 which is illustrated by dotted lines.

From FIG. 8 appears that below tube 24 an L-section 31 has been placed against said tube with rows discharging openings 32 and 33, which space 34 in the section is supplied from the tube 24 through the bore 35.

On both sides of the discharging openings 32 and 33 now are strips 36 and 37. In the middle a centering cone 38 is mounted which extends more downwardly.

Figure 8:
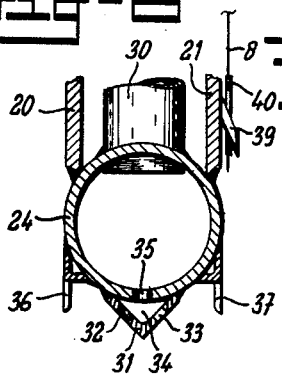
FIG. 8 is a cross section along line VIII—VIII of FIG. 5, in which a suitable attaching method for the sheet is shown.

In FIG. 8 a downwardly inclined pin 39 is shown, several of which can be mounted distributed across the lower edge of the wall 21 and which stitch into the cloth eyelets 40 of sheet 8. If the injection lance is moved upwardly (indicated at the right hand side in FIG. 8) then the pins 39 withdraw from the eyelets 40.

Figure 9:
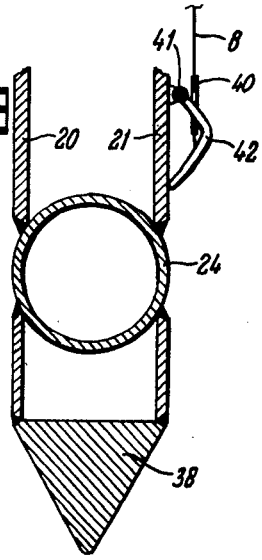
FIG. 9 is a cross section along line IX—IX of FIG. 5 and shows another attaching method.

FIG. 9 shows an other possibility according to which a shaft 41 is rotatably mounted against the side wall 21, on said shaft several hooks 42 are mounted, which can stitch into the cloth eyelets. Counter clockwise rotation of shaft 41 positions the hooks 42 such that the cloth eyelets are released.

Figure 10:
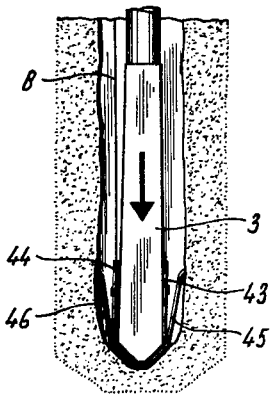
FIG. 10 is a side elevation of the lower part of the lance with a further attaching method for the sheet.
Figure 11:
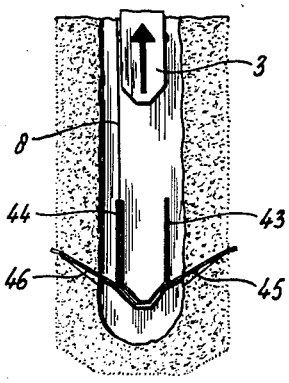
FIG. 11 shows this attaching method in unlatched position.

FIGS. 10 and 11 show an other modification for the attachment of the sheet 8. At the lance 3 are mounted U-shaped resilient clamps 43 to which the lower edge of the sheet, shown at 44 is attached. These clamps have resilient tongues 45, 46. If, as shown in FIG. 11, the lance is lifted, the tongues 45, 46 enter the soil, whereby the clamps 43 are slid off the injection lance.

Figure 12:
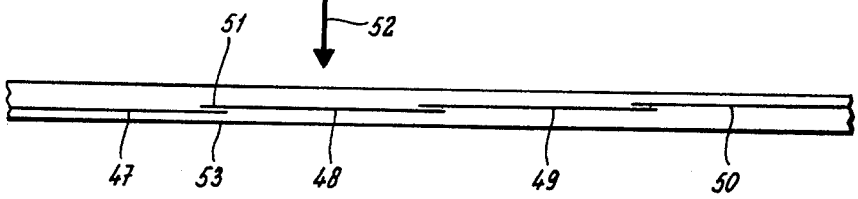
FIG. 12 shows schematically and in top view how the sheets forming the screen according to the invention can join each other.

FIG. 12 shows in top view a screen that is assembled from the sheets 47, 48, 49 and 50. So an unlimited number of sheets can be mounted next to each other and the path can have any desired shape. As shown in FIG. 12, the sheets are mounted with an overlap. After mounting for instance the sheet 47 the next sheet 48 is mounted such that its edge 51 lies on the highest pressure side of sheet 47 indicated by arrow 52. The edge 51 is then forced by ground water pressure against sheet 47 said sheet being supported by the side wall 53 of the slot. At each overlap this method is proceeded. The overlap must have sufficient width for instance of some decimeters.

Figure 13:
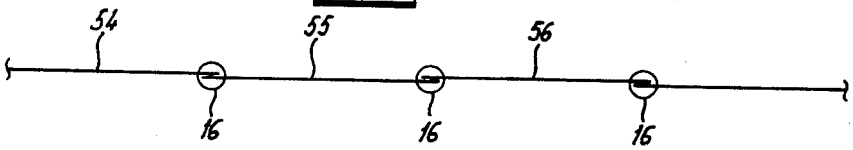
FIGS. 13, 14, 15 and 16 show similar as FIG. 12 modifications of this.

In FIG. 13 a screen is shown at which the bores 16 shown in FIGS. 3 and 4 are used. The sheets 54, 55, 56 stitch with their edges in these bores 16 such that the edges overlap each other. If the bores 16 are filled afterwards with hardening material, the edges are enclosed very well.

Figure 14:
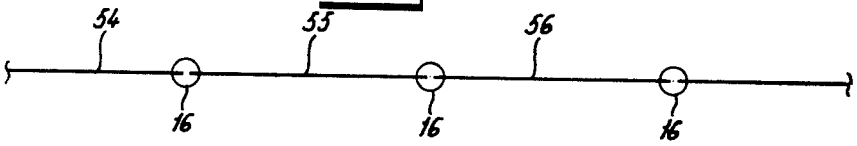

In FIG. 14 the same situation is shown, now however such that the edges of the sheets do not overlap each other, but are spaced from each other. Also in that case the hardening material can bring about a good closure and sealing.

Figure 15:
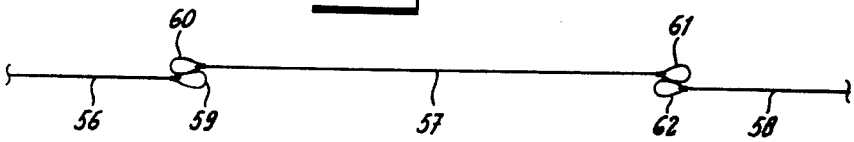

FIG. 15 shows sheets 56, 57, 58 which are provided at the side edges with inflatable hollow edge strips 59, 60, 61 and 62. The inflated edge strips overlapping each other seal the sheets to each other and keep them positioned.

Figure 16:
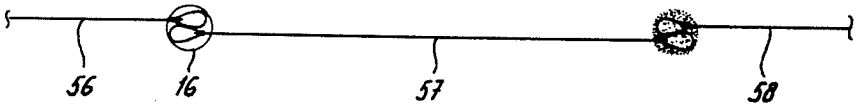

FIG. 16 shows that this method of anchoring can also occur inside a bore 16.

If for the edge strips a permeable material is used, one can fill in this way the bores 16 either fully or partly. If the bores are not provided one can however use permeable material as shown at the right hand side in FIG. 16. The hardening material coming from the walls of the hollow edge strips penetrates into the soil and connects both hollow edge strips very well to each other.

Figure 17:
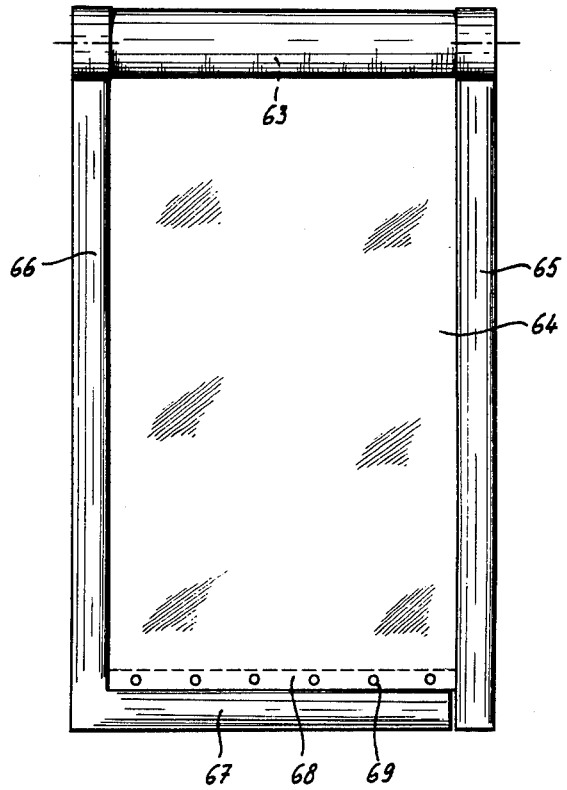
FIG. 17 is a side view of a sheet.
Figure 18:
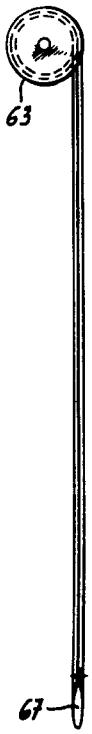
FIG. 18 is a vertical section of the sheet of FIG. 17.
Figure 19:
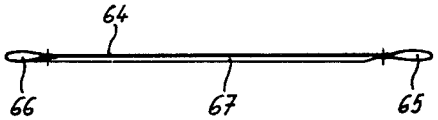
FIG. 19 is a horizontal section of the sheet of FIGS. 17 and 18.

FIGS. 17, 18 and 19 show an embodiment of the sheet which is on a storage reel 63. This sheet 64 has edge strips 65 and 66 as well as an lower edge strip 67. The edge strip 66 and the lower edge strip 67 are connected to each other. The edge strip 65 is independent of the lower edge strip 67. Such a sheet can for instance be used with the attaching means shown in FIG. 8 or 9. After mounting a sheet the edge strips 66 and 67 as well as the edge strip lying adjacent to the edge strip 66 and comparable with the edge strip 65 of the preceding sheet, are completely filled by pumping with hardening material. Upon completely filling of the edge strip 66 by pumping also the lower edge strip 67 is completely filled by pumping. If the lance is lifted afterwards, the sheet remains at its place because the expanded lower edge strip 67 does not permit displacement. At 68 an edge with cloth eyelets 69 is shown, which can cooperate with attachment hooks as hooks 39.

I claim:

1. A method for manufacturing a ground-water barrier by introducing multiple, flexible, water-restraining, non-self supporting sheets into the soil, said method comprising introducing a first said sheet downwardly through the soil by releasably attaching the lower edge of said sheet to a liquid-ejecting lance having substantially the same width as said sheet, moving said lance together with said sheet downwardly through the soil while simultaneously ejecting liquid from the lance downwardly into the path of said lance, disconnecting the lance from said sheet, and retracting the lance from the soil, and introducing a second said sheet into said soil, positioned so that a portion of said second sheet sealingly overlaps a portion of said first sheet, whereby sealing is brought about along said overlapping portions.

2. A method of according to claim 1, characterized in that at least during said retraction, the lance is submitted to vibrations.

3. A method according to claim 1 characterized in that the sheets are positioned overlapping each other such that they seal upon each other with the edge faces covering each other, with the edge face of each sheet over the edge face of the preceding sheet, which is turned towards the highest water pressure side.

4. A method according to claim 1 characterized in that downwardly directed holes are provided along the barrier to be constructed by means of drilling or injection, which holes are spaced apart a distance which is adapted to the width of the sheets and each sheet is introduced downwardly into the soil by the injection lance connected thereto with the opposite sheet edges located at adjacent holes, after which hardening material is introduced, at least in the hole in which the edges of two succeeding sheets are located.

* * * * *